US010828753B1

(12) United States Patent
Blackwell

(10) Patent No.: US 10,828,753 B1
(45) Date of Patent: Nov. 10, 2020

(54) NUT-DISPENSING TOOL

(71) Applicant: Barry Blackwell, Mount Mourne, NC (US)

(72) Inventor: Barry Blackwell, Mount Mourne, NC (US)

( * ) Notice: Subject to any disclaimer, the term of this patent is extended or adjusted under 35 U.S.C. 154(b) by 0 days.

(21) Appl. No.: 16/659,671

(22) Filed: Oct. 22, 2019

(51) Int. Cl.
*B25B 23/04* (2006.01)

(52) U.S. Cl.
CPC ..... *B25B 23/04* (2013.01)

(58) Field of Classification Search
None
See application file for complete search history.

(56) References Cited

U.S. PATENT DOCUMENTS 1,543,175 A 6/1925 McCarthy
2,412,275 A 12/1946 Klopovic
2,611,289 A 9/1952 Louis
3,005,367 A 10/1961 Vose
4,474,090 A * 10/1984 Berecz ..... B25B 23/06 81/125
5,044,225 A * 9/1991 Louw ..... B25B 23/04 81/430
5,551,321 A 9/1996 Bottiglieri
5,640,889 A 6/1997 Anderson
D411,723 S 6/1999 Lamerrill

FOREIGN PATENT DOCUMENTS

WO 1998032568 7/1998

* cited by examiner

*Primary Examiner* — Gene O Crawford
*Assistant Examiner* — Ayodeji T Ojofeitimi
(74) *Attorney, Agent, or Firm* — Kyle A. Fletcher, Esq.

(57) ABSTRACT

The nut-dispensing tool comprises a tube, a retaining block, and a spring loaded gas cylinder. The nut-dispensing tool may dispense a plurality of threaded nuts individually from the tube via a removal slot located in the retaining block. The plurality of threaded nuts may be pushed towards the removal slot by the spring loaded gas cylinder. An individual threaded nut may be removed by inserting a threaded stud member into the individual threaded nut via an end aperture of the retaining block, turning the threaded stud member to engage stud threading into nut threading, and lifting the individual threaded nut through the removal slot using the threaded stud member.

18 Claims, 4 Drawing Sheets

NUT-DISPENSING TOOL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of industrial tools, more specifically, a nut-dispensing tool.

SUMMARY OF INVENTION

The nut-dispensing tool comprises a tube, a retaining block, and a spring loaded gas cylinder. The nut-dispensing tool may dispense a plurality of threaded nuts individually from the tube via a removal slot located in the retaining block. The plurality of threaded nuts may be pushed towards the removal slot by the spring loaded gas cylinder. An individual threaded nut may be removed by inserting a threaded stud member into the individual threaded nut via an end aperture of the retaining block, turning the threaded stud member to engage stud threading into nut threading, and lifting the individual threaded nut through the removal slot using the threaded stud member.

An object of the invention is to dispense a plurality of threaded nuts one at a time.

Another object of the invention is to dispense an individual thread nut via a retaining block located at a proximal tube end.

A further object of the invention is to push the plurality of threaded nuts towards the proximal tube end using a spring loaded gas cylinder Yet another object of the invention is to provide an end aperture and a removal slot on a retaining block such that a threaded stud member may engage with an individual thread nut while the individual threaded nut is held within the retaining block.

These together with additional objects, features and advantages of the nut-dispensing tool will be readily apparent to those of ordinary skill in the art upon reading the following detailed description of the presently preferred, but nonetheless illustrative, embodiments when taken in conjunction with the accompanying drawings.

In this respect, before explaining the current embodiments of the nut-dispensing tool in detail, it is to be understood that the nut-dispensing tool is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the nut-dispensing tool.

It is therefore important that the claims be regarded as including such equivalent construction insofar as they do not depart from the spirit and scope of the nut-dispensing tool. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
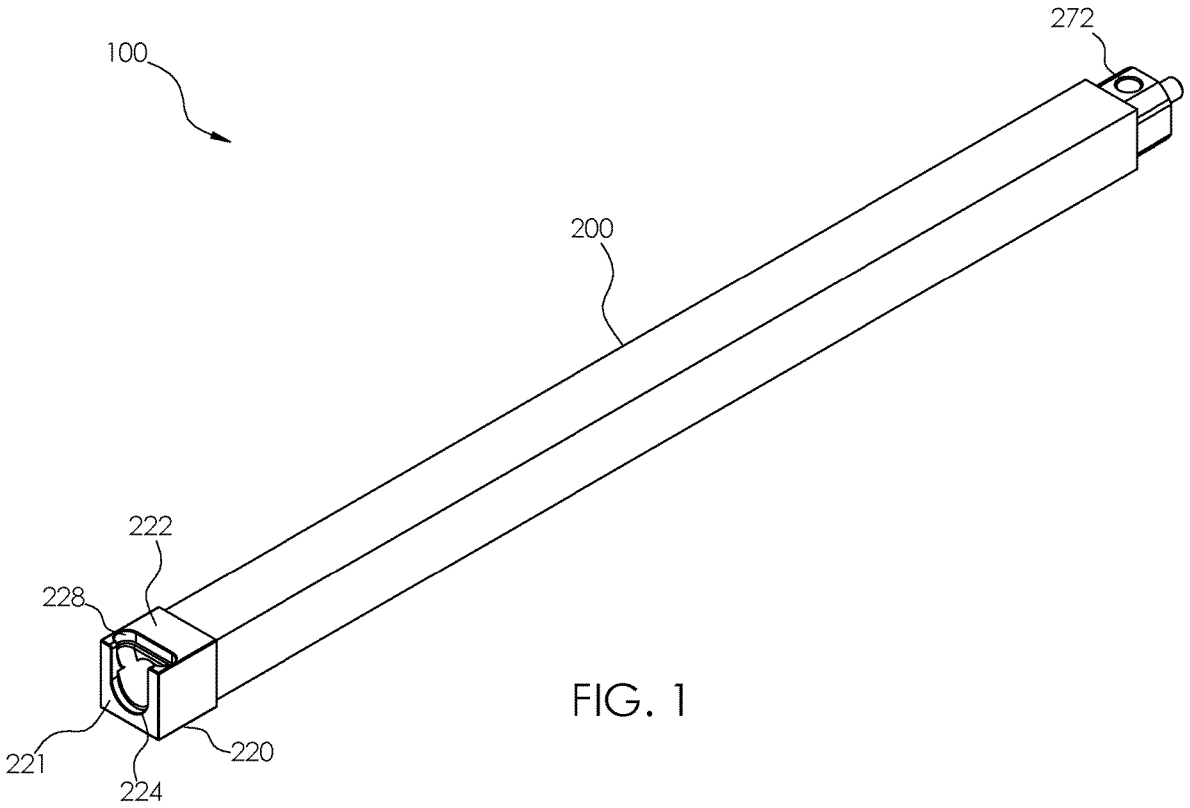
FIG. 1 is an isometric view of an embodiment of the disclosure.
Figure 2:
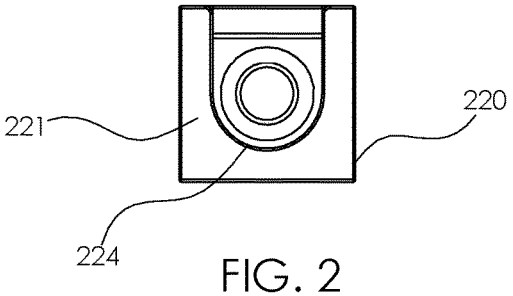
FIG. 2 is a top view of an embodiment of the disclosure.
Figure 3:
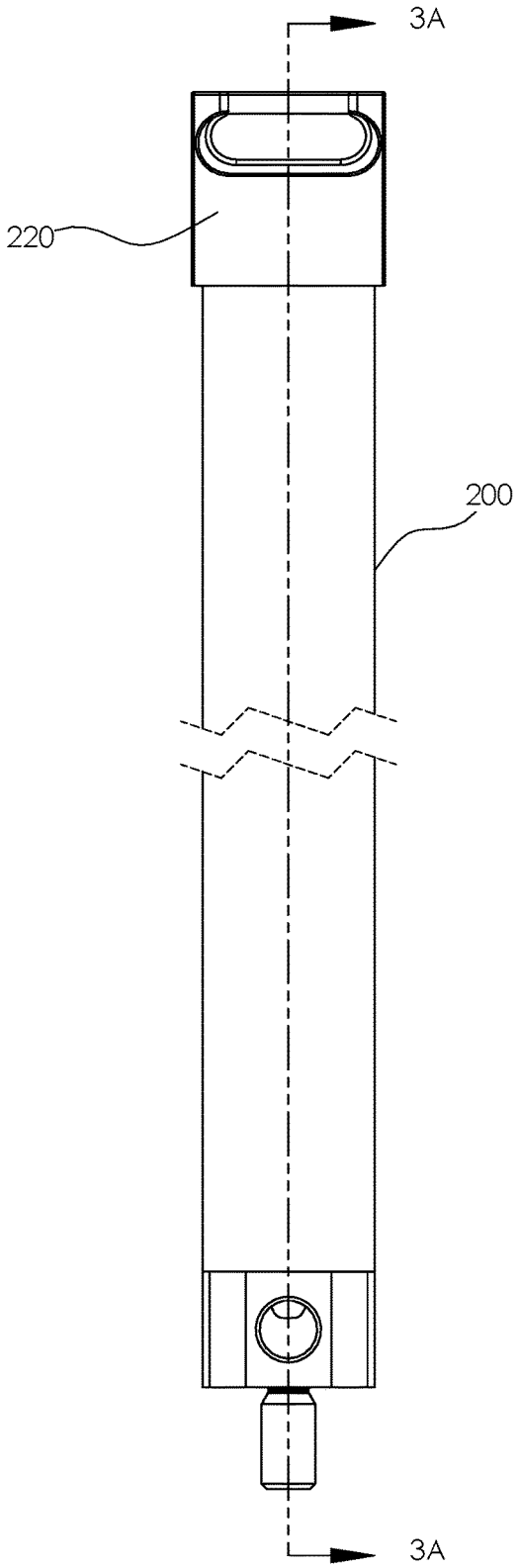
FIG. 3 is a side view of an embodiment of the disclosure.
Figure 3A:
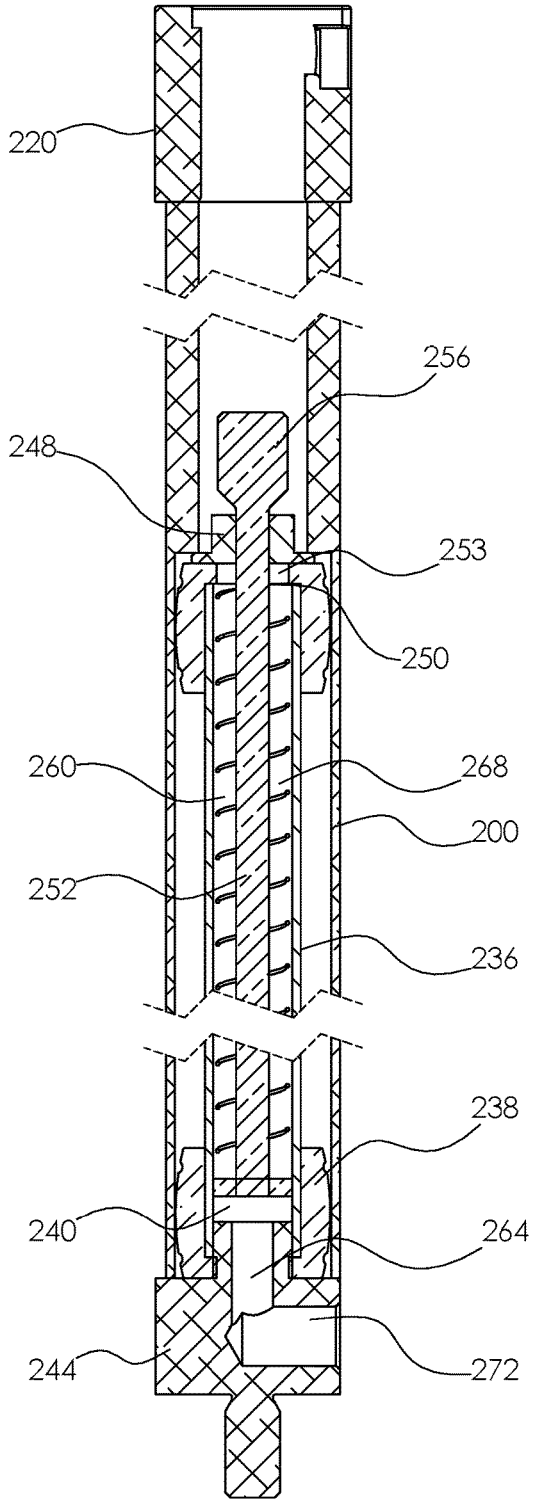
FIG. 3A is a cross-sectional view of an embodiment of the disclosure across 3A-3A as shown in FIG. 3.
Figure 4:
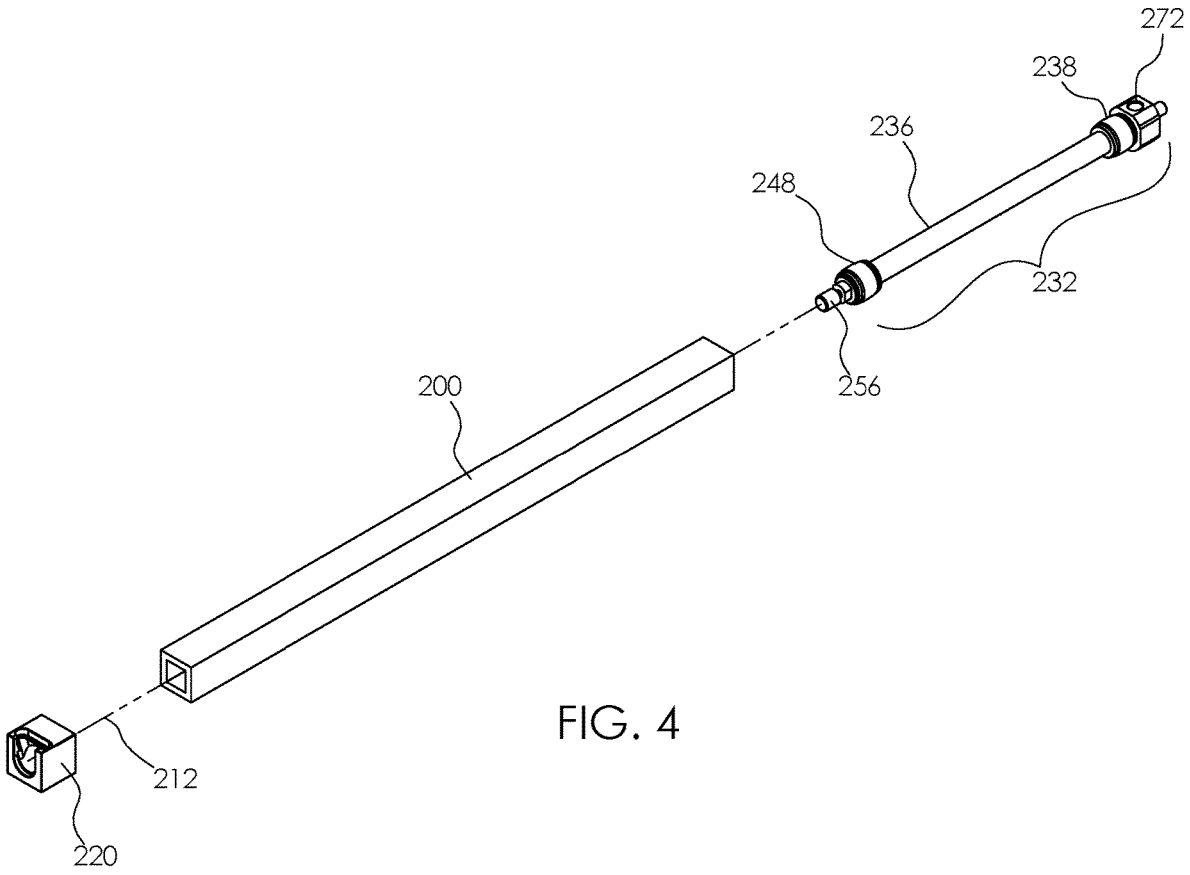
FIG. 4 is an exploded view of an embodiment of the disclosure.
Figure 5:
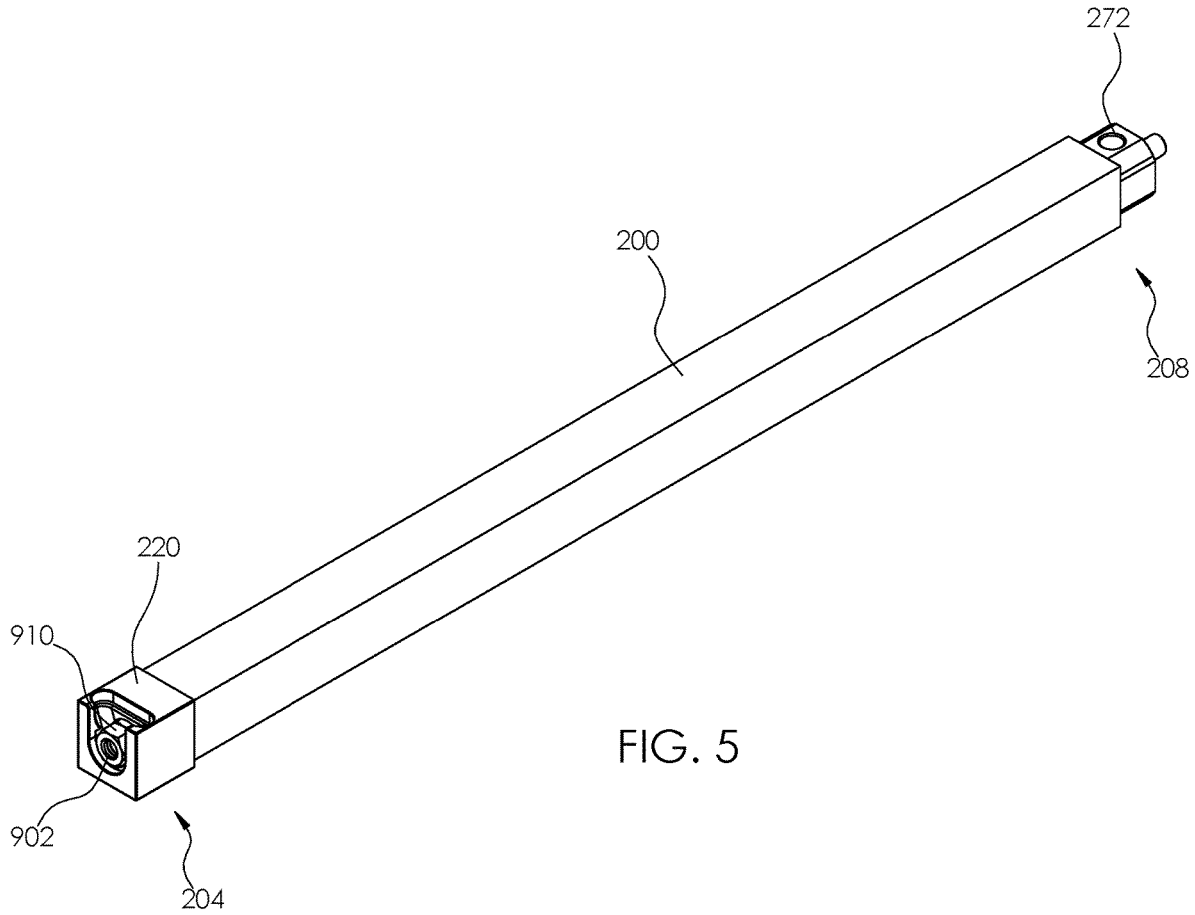
FIG. 5 is an in-use view of an embodiment of the disclosure illustrating a threaded nut in position within the retaining block at the proximal end of the tube.

Detailed reference will now be made to a first potential embodiment of the disclosure, which is illustrated in FIGS. 1 through 5.

The nut-dispensing tool 100 (hereinafter invention) comprises a tube 200, a retaining block 220, and a spring loaded gas cylinder 232. The invention 100 may dispense a plurality of threaded nuts individually from the tube 200 via a removal slot 228 located in the retaining block 220. The plurality of threaded nuts may be pushed towards the removal slot 228 by the spring loaded gas cylinder 232. An individual threaded nut 910 may be removed by inserting a threaded stud member into the individual threaded nut 910 via an end aperture 224 of the retaining block 220, turning the threaded stud member to engage stud threading into nut threading, and lifting the individual threaded nut 910 through the removal slot 228 using the threaded stud member.

The tube 200 may be hollow enclosure for containing the plurality of threaded nuts. The tube 200 may comprise a proximal tube end 204 and a distal tube end 208. The retaining block 220 may couple to the tube 200 at the proximal tube end 204. The spring loaded gas cylinder 232 may couple to the tube 200 via the distal tube end 208. The tube 200 may have a cross-sectional shape that corresponds to the shape of the plurality of threaded nuts that are dispensed from the invention 100. In some embodiments, the tube 200 may have a square cross-section. The interior diameter of the tube 200 may be at least as large as the outside diameter of the plurality of threaded nuts that are dispensed such the plurality of threaded nuts may fit within the tube 200 with a center aperture 902 of each of the plurality of threaded nuts aligned along a centerline of the tube 212 of the tube 200.

The retaining block 220 may cap the proximal tube end 204 of the tube 200 to retain the plurality of threaded nuts within the tube 200. The retaining block 220 may fit over the outside of the proximal tube end 204 of the tube 200. An end wall 221 of the retaining block 220 may comprise the end aperture 224. A threaded shaft of the threaded stud member may contact the individual threaded nut 910 via the end aperture 224. The diameter of the end aperture 224 may be larger than the diameter of the threaded shaft but smaller than the outer diameter of the individual threaded nut 910 such that the individual threaded nut 910 cannot pass through the end aperture 224. The retaining block 220 may comprise the removal slot 228 on a side wall 222 of the retaining block 220.

The spring loaded gas cylinder 232 may comprise a body 236, an end plug 244, a nose bearing 248, a piston 240, a rod 252, a gas chamber 264, a spring chamber 268, a coil spring 260, and a gas inlet 272. The spring loaded gas cylinder 232 may apply force to the plurality of threaded nuts such that the plurality of threaded nuts are pushed towards the retaining block 220. Specifically, gas within the spring loaded gas cylinder 232 may push against the piston 240 coupled to the rod 252 such that the rod 252 is pushed out of the spring loaded gas cylinder 232 and against the plurality of threaded nuts.

The body 236 may be an enclosure for the spring loaded gas cylinder 232. The body 236 may be inserted into the tube 200 via the distal tube end 208. In some embodiments, one or more spacers 238 may compensate for a difference between the outside diameter of the body 236 of the spring loaded gas cylinder 232 and the inside diameter of the tube 200.

The end plug 244 may seal the distal end of the body 236. In some embodiments, the end plug 244 may comprise the gas inlet for inserting the gas into the gas chamber 264 and for removing the gas from the gas chamber 264.

The nose bearing 248 may seal the proximal end of the body 236. The nose bearing 248 may comprise a rod aperture 250 through which the rod 252 exits the body 236. In some embodiments, the rod aperture 250 may be surrounded by a rod seal 253.

The piston 240 may be a moving cylindrical component within the body 236. The piston 240 may separate the interior of the body 236 into the gas chamber 264 located on the distal side of the piston 240 and the spring chamber 268 located on the proximal side of the piston 240. The proximal side of the piston 240 may be coupled to the distal end of the rod 252.

The rod 252 may be a shaft that couples to the piston 240 and extends out of the proximal end of the body 236 such that pressure exerted on the distal side of the piston 240 by the gas may move the rod 252 in the proximal direction. The rod 252 may comprise a head 256 located at the proximal end of the rod 252. The head 256 may push against the plurality of threaded nuts.

The head 256 may be an enlargement of the rod 252 that assures that the rod 252 will not pass through the center apertures 902 of the plurality of threaded nuts.

The gas chamber 264 may be filled with the gas which is under pressure such that the gas exerts a force against the piston 240. The spring chamber 268 may house the coil spring 260.

The coil spring 260 may be a mechanical spring that pushes the proximal side of the piston 240. The coil spring 260 may be located within the spring chamber 268 between the piston 240 and the nose bearing 248. The coil spring 260 may push the piston 240 away from the nose bearing 248 such that the piston 240 moves towards the distal end of the body 236 in the absence of pressure from the gas.

In some embodiments, the gas inlet 272 may allow connection of a hose to pump the gas into the gas chamber 264 and to remove the gas from the gas chamber 264. In some embodiments, the gas may be removed from the gas chamber 264 when the tube 200 is empty of the plurality of threaded nuts thus allowing the coil spring 260 to retract the rod 252 and the head 256. With the rod 252 and the head 256 retracted, the retaining block 220 may be removed to insert the plurality of threaded nuts.

In some embodiments, the spring loaded gas cylinder 232 may be removed from the tube 200 when the tube 200 is empty of the plurality of threaded nuts and the plurality of threaded nuts may be inserted into the tube 200 from the distal tube end 208. The spring loaded gas cylinder 232 may then be reinserted and the spring loaded gas cylinder 232 may be compressed as the spring loaded gas cylinder 232 is inserted.

In use, the plurality of threaded nuts may be loaded into the tube 200 by removing the spring loaded gas cylinder 232 and placing the plurality of threaded nuts into the distal tube end 208. The spring loaded gas cylinder 232 may then be reinserted into the tube 200 to apply pressure to the plurality of threaded nuts. Depending upon the embodiment, the gas may or may not be released from the spring loaded gas cylinder 232 during the reloading process. Alternatively, the gas may be released from the spring loaded gas cylinder 232, the retaining block 220 may be removed, the plurality of threaded nuts may be loaded into the proximal tube end 204, the retaining block 220 may be reinstalled, and the gas may be loaded into the spring loaded gas cylinder 232. When the gas is released from the spring loaded gas cylinder 232 via the gas inlet 272, the coil spring 260 may push the piston 240, and thus the rod 252 and the head 256, away from the proximal tube end 204, making way for the plurality of threaded nuts. The plurality of threaded nuts may be removed from the retaining block 220 one at a time by pushing the threaded stud member into the center aperture 902 via the end aperture 224, rotating the threaded stud member to engage the stud threading with the nut threading, and then lifting the threaded stud member to slide the individual threaded nut 910 out of the retaining block 220.

Definitions

As used in this disclosure, an "aperture" is an opening in a surface. Aperture may be synonymous with hole, slit, crack, gap, slot, or opening.

As used in this disclosure, the "centerline" is an imaginary line that defines the center of one or more cross sections of an object. Unless stated otherwise, the centerline follows a longitudinal path through the object at the center of lateral cross sections. If the object is tubular, the centerline follows the center of the tube.

As used in this disclosure, the word "correspond" indicates that a first object is in some manner linked to a second object in a one to one relationship or that one or more properties shared by two or more objects match, agree, or align within acceptable manufacturing tolerances.

As used herein, the words "couple", "couples", "coupled" or "coupling", refer to connecting, either directly or indirectly, and does not necessarily imply a mechanical connection.

As used in this disclosure, a "cross-section" is a surface or shape that would be exposed by making a straight cut through an object.

As used in this disclosure, a "diameter" of an object is a straight line segment that passes through the center (or center axis) of an object. The line segment of the diameter is terminated at the perimeter or boundary of the object through which the line segment of the diameter runs.

As used in this disclosure, the terms "distal" and "proximal" may be used to describe relative positions. Distal refers to the object, or the end of an object, that is situated away from the point of origin, point of reference, or point of attachment. Proximal refers to the object, or end of an object, that is situated towards the point of origin, point of reference, or point of attachment. Distal implies 'farther away from' and proximal implies 'closer to'. In some instances, the point of attachment may be the where an operator or user of the object makes contact with the object. In some instances, the point of origin or point of reference may be a center point, a central axis, or a centerline of an object and the direction of comparison may be in a radial or lateral direction.

As used herein, "inside diameter" or "inner diameter" refers to a measurement made on a hollow object. Specifically, the inside diameter is the distance from one inside wall to the opposite inside wall. If the object is round, then the inside diameter is a true diameter, however the term may also be used in connection with a square object in which case the inside diameter is simply the narrowest inside measurement that passes through the center of the object.

As used in this disclosure, the word "interior" is used as a relational term that implies that an object is located or contained within the boundary of a structure or a space.

As used herein, "outside diameter" or "outer diameter" refers to a measurement made on an object. Specifically, the outside diameter is the distance from one point on the outside of the object to a point on the opposite side of the object along a line passing through the center of the object. The term outside diameter is frequently used in conjunction with round objects such as hollow conduits in which case the outside diameter is a true diameter, however the term may also be used in connection with a square object in which case the outside diameter is simply the widest outside measurement that passes through the center of the conduit.

As used in this disclosure, a "rod" is a straight structure in which two dimensions of the structure appear thin relative to a third dimension of the straight structure.

As used in this disclosure, the term "shaft" is used to describe a rigid cylinder. A shaft is often used as the handle of a tool or implement or as the center of rotating machinery or motors. The definition of shaft explicitly includes solid shafts or shafts that comprise a hollow passage through the shaft along the center axis of the shaft cylinder, whether the shaft has one or more sealed ends or not.

As used in this disclosure, a "slot" is a long narrow groove, cut, opening, or aperture that is formed in or through an object.

As used in this disclosure, a "spring" is a device that is used to store mechanical energy. This mechanical energy will often be stored by deforming an elastomeric material that is used to make the device, by the application of a torque to a rigid structure, or by a combination thereof. In some embodiments, the rigid structure to which torque is applied may be composed of metal or plastic.

As used herein, "spring loaded" refers to an item that contains a compressed or stretched spring that presses one part against another part.

As used in this disclosure, a "tool" is a device, an apparatus, or an instrument that is used to carry out an activity, operation, or procedure.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A nut-dispensing tool comprising:

a tube, a retaining block, and a spring loaded gas cylinder;

wherein the nut-dispensing tool dispenses a plurality of threaded nuts individually from the tube via a removal slot located in the retaining block;

wherein the plurality of threaded nuts are pushed towards the removal slot by the spring loaded gas cylinder;

wherein an individual threaded nut is removed by inserting a threaded stud member into the individual threaded nut via an end aperture of the retaining block, turning the threaded stud member to engage stud threading into nut threading, and lifting the individual threaded nut through the removal slot using the threaded stud member;

wherein the tube is hollow enclosure for containing the plurality of threaded nuts;

wherein the tube comprises a proximal tube end and a distal tube end;

wherein the retaining block couples to the tube at the proximal tube end;

wherein the spring loaded gas cylinder couples to the tube via the distal tube end.

2. The nut-dispensing tool according to claim 1 wherein the tube has a cross-sectional shape that corresponds to the shape of the plurality of threaded nuts that are dispensed from the nut-dispensing tool.

3. The nut-dispensing tool according to claim 2 wherein the tube has a square cross-section;

wherein the interior diameter of the tube is at least as large as the outside diameter of the plurality of threaded nuts that are dispensed such the plurality of threaded nuts fit within the tube with a center aperture of each of the plurality of threaded nuts aligned along a centerline of the tube of the tube.

4. The nut-dispensing tool according to claim 2 wherein the retaining block caps the proximal tube end of the tube to retain the plurality of threaded nuts within the tube;

wherein the retaining block fits over the outside of the proximal tube end of the tube;

wherein an end wall of the retaining block comprises the end aperture;

wherein a threaded shaft of the threaded stud member contacts the individual threaded nut via the end aperture;

wherein the diameter of the end aperture is larger than the diameter of the threaded shaft but smaller than the outer diameter of the individual threaded nut such that the individual threaded nut cannot pass through the end aperture;

wherein the retaining block comprises the removal slot on a side wall of the retaining block.

5. The nut-dispensing tool according to claim 4 wherein the spring loaded gas cylinder comprises a body, an end plug, a nose bearing, a piston, a rod, a gas chamber, a spring chamber, a coil spring, and a gas inlet;

wherein the spring loaded gas cylinder applies force to the plurality of threaded nuts such that the plurality of threaded nuts are pushed towards the retaining block;

wherein gas within the spring loaded gas cylinder pushes against the piston coupled to the rod such that the rod is pushed out of the spring loaded gas cylinder and against the plurality of threaded nuts.

6. The nut-dispensing tool according to claim 5 wherein the body is an enclosure for the spring loaded gas cylinder;

wherein the body is inserted into the tube via the distal tube end.

7. The nut-dispensing tool according to claim 6 wherein one or more spacers compensate for a difference between the outside diameter of the body of the spring loaded gas cylinder and the inside diameter of the tube.

8. The nut-dispensing tool according to claim 6 wherein the end plug seals the distal end of the body.

9. The nut-dispensing tool according to claim 8 wherein the end plug comprises the gas inlet for inserting the gas into the gas chamber and for removing the gas from the gas chamber.

10. The nut-dispensing tool according to claim 9 wherein the nose bearing seals the proximal end of the body;

wherein the nose bearing comprises a rod aperture through which the rod exits the body.

11. The nut-dispensing tool according to claim 10 wherein the rod aperture is surrounded by a rod seal.

12. The nut-dispensing tool according to claim 10 wherein the piston is a moving cylindrical component within the body;

wherein the piston separates the interior of the body into the gas chamber located on the distal side of the piston and the spring chamber located on the proximal side of the piston;

wherein the proximal side of the piston is coupled to the distal end of the rod.

13. The nut-dispensing tool according to claim 12 wherein the rod is a shaft that couples to the piston and extends out of the proximal end of the body such that pressure exerted on the distal side of the piston by the gas moves the rod in the proximal direction;

wherein the rod comprises a head located at the proximal end of the rod;

wherein the head pushes against the plurality of threaded nuts;

wherein the head is an enlargement of the rod that assures that the rod will not pass through the center apertures of the plurality of threaded nuts.

14. The nut-dispensing tool according to claim 13 wherein the gas chamber is filled with the gas which is under pressure such that the gas exerts a force against the piston;

wherein the spring chamber houses the coil spring.

15. The nut-dispensing tool according to claim 14 wherein the coil spring is a mechanical spring that pushes the proximal side of the piston;

wherein the coil spring is located within the spring chamber between the piston and the nose bearing;

wherein the coil spring pushes the piston away from the nose bearing such that the piston moves towards the distal end of the body in the absence of pressure from the gas.

16. The nut-dispensing tool according to claim 15 wherein the gas inlet allows connection of a hose to pump the gas into the gas chamber and to remove the gas from the gas chamber.

17. The nut-dispensing tool according to claim 16 wherein the gas is removed from the gas chamber when the tube is empty of the plurality of threaded nuts thus allowing the coil spring to retract the rod and the head;

wherein with the rod and the head retracted, the retaining block is removed to insert the plurality of threaded nuts.

18. The nut-dispensing tool according to claim 17 wherein the spring loaded gas cylinder is removed from the tube when the tube is empty of the plurality of threaded nuts and the plurality of threaded nuts are inserted into the tube from the distal tube end;

wherein the spring loaded gas cylinder is then reinserted and the spring loaded gas cylinder is compressed as the spring loaded gas cylinder is inserted.

* * * * *